US005617806A

United States Patent [19]

Goldman

[11] Patent Number: 5,617,806

[45] Date of Patent: Apr. 8, 1997

[54] DEVICE FOR SECURING A COLLISION GUARD TO A VESSEL

[76] Inventor: Jerome L. Goldman, 935 Gravier St., New Orleans, La. 70112

[21] Appl. No.: 328,748

[22] Filed: Oct. 24, 1994

[51] Int. Cl.[6] ..... B63B 43/18

[52] U.S. Cl. ..... 114/74 A; 114/219; 114/69

[58] Field of Search ..... 114/1, 9, 10, 11, 114/12, 13, 14, 15, 65 R, 352, 353, 68, 69, 219, 74 A, 77 R, 77 A

[56] References Cited

U.S. PATENT DOCUMENTS

| | | | |
|---|---|---|---|
| 2,401,453 | 6/1946 | Bell et al. | 114/77 R |
| 4,013,030 | 3/1977 | Stafford | 114/74 A |
| 4,066,184 | 1/1978 | Cuthbert et al. | 114/74 A |
| 5,018,997 | 5/1991 | Guptill | 114/219 |
| 5,261,342 | 11/1993 | Griggs | 114/219 |
| 5,353,727 | 10/1994 | Goldman | 114/12 |

*Primary Examiner*—Stephen Avila
*Attorney, Agent, or Firm*—Keaty & Keaty

[57] ABSTRACT

The invention relates to a device for allowing securing of a collision guard to a side of a vessel. A vertically oriented post is fixedly attached to and extends upwardly from the collision guard and has an upper part which is received in a gap formed between a pair of vertically spaced-apart horizontally extending retainer plates. An enclosure formed between the retainer plates surrounds the posts on those sides which do not face the hull of the vessel. Adjustable screw jacks extend through the openings formed in the enclosure side walls to selectively adjustably contact the side walls of the post to thereby secure the retainer plates to the post. An attachment bolster mounted on a top deck of the vessel allows fixed attachment of the retainer plates to the vessel.

5 Claims, 4 Drawing Sheets

DEVICE FOR SECURING A COLLISION GUARD TO A VESSEL

BACKGROUND OF THE INVENTION

The present invention relates to marine vessels, and more particularly to a vessel provided with collision protection means installed directly on the hull of the vessel.

With the increased transportation of hazardous materials by marine vessels, such as self propelled tankers and/or towed barges, environmental agencies of many countries require the new ships to be constructed with enhanced resistance to impact of the hull or bottom of the vessel, since such an impact can create spillage and result in an environmental disaster.

For example, U.S. Laws require that vessels have double hull construction to provide for empty space in between the oil tanks and the vessel sides and bottom. It is acknowledged that provision of the double hull can effectively protect against minor impacts, but will be ineffective in the case of impact of a more serious nature. During such impacts, a ship carrying environmentally sensitive cargo is frequently struck in its side by another vessel's bow. The striking vessel's bow penetrates the other vessel's side until the kinetic energy of the striking vessel is absorbed. The damaged vessel absorbs collision energy by distortion and mangling actions resulting in destruction of part of the hull. The exterior shell of the ship offers little resistance and most of the collision energy is absorbed by destroying areas of horizontal plating, such as decks and double bottoms. The collision can even result in permanent damage of the ship to the point where the ship could break into two parts.

Various designs have been suggested for improving impact resistance of a ship. One of such solutions is disclosed in my U.S. Pat. No. 5,353,727, issued on Oct. 11, 1994, entitled "Collision Guard For A Vessel". In that patent, the collision guard is disclosed to comprise buoyant modules, each separately secured to a corresponding side wall of the hull through the means of a post and cap attachment. The collision guards are formed with recesses in the top wherein the caps and the posts are located. The caps and load spreading attachment brackets are welded to the side of the ship. The caps capture the posts and prevent them from moving vertically or horizontally.

While this design is workable in many environments, the present invention contemplates provision of an improved device for securing the collision guard to the vessel by providing easy access to the securing means as well as eliminating the need for precise fitting of vertical mating surfaces between the cap and the post. Additional consideration was taken into account that heating and cooling of the steel hull in the area of welding may cause distortion of the attachment structure and the hull.

SUMMARY OF THE INVENTION

It is, therefore, an object of the present invention to provide an improved device for securing collision guards to a vessel.

It is another object of the present invention to provide the securing device which is easily accessible during installation and servicing.

It is a further object of the present invention to provide a device for securing the collision guard which allows accurate and complete contact between the post and the retaining plates, or caps.

It is still a further object of the present invention to provide an improved device for securing the collision guard to a vessel which is easy to install and inexpensive to manufacture.

These and other objects of the present invention are achieved through a provision of a device for securing a collision guard to a side of a vessel which comprises a vertically oriented post fixedly attached to the collision guard and extending upwardly therefrom. A retainer cap comprised of a pair of horizontally extending vertically spaced-apart retainer plates defines a gap within which a top part of the post is received.

An enclosure mounted within the gap is located in at least partially surrounding relationship about the post. The enclosure is formed by vertically extending walls, with each of the wall being provided with a through aperture. The post is adjustably secured to the retainer cap by a plurality of screw jacks which are threadably selectively adjustably engaged within apertures of the side walls, extending through the side walls of the enclosure to contact the vertically extending side walls of the post.

A free end of the screw jacks is adapted to receive torque from an external power source. By adjusting the contact pressure on the post, the accurate and precise positioning of the retainer cap to the post is achieved.

In order to secure the retainer plates to the vessel, an attachment bolster is mounted on a top deck of the vessel to allow fixed attachment of the retainer plates, such as by welding, thereto. The attachment bolster extends upwardly vertically from the deck and has a side wall to which the retainer plates are fixedly secured. To prevent corrosion of the collision guard, a seal is formed in a gap between the inner wall of the collision guard and an exterior wall of the hull which prevents the corrosive sea water from entering the gap.

BRIEF DESCRIPTION OF THE DRAWINGS

Reference will now be made to the drawings, wherein like parts are designated by like numerals and wherein.

DETAILED DESCRIPTION OF THE PREFERRED EMBODIMENT

Figure 3:
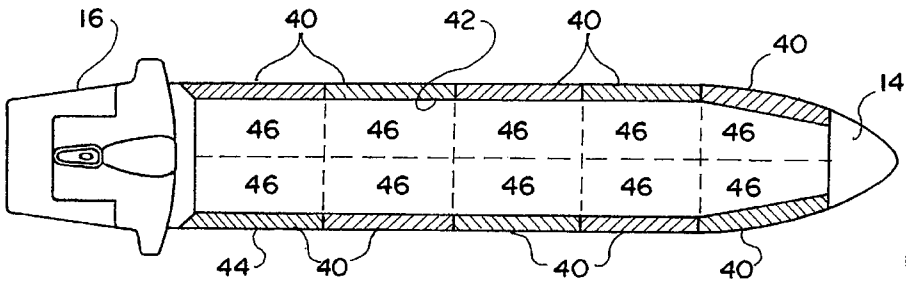
FIG. 3 is a top view of the vessel illustrating position of the collision guards on the sides of the ship.
Figure 1:
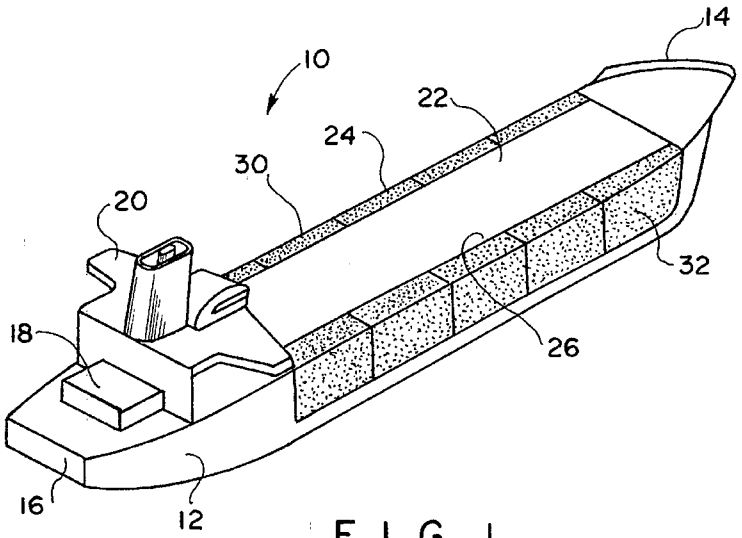
FIG. 1 is a perspective view of a marine vessel carrying collision guards attached to the sides of the vessel.
Figure 2:
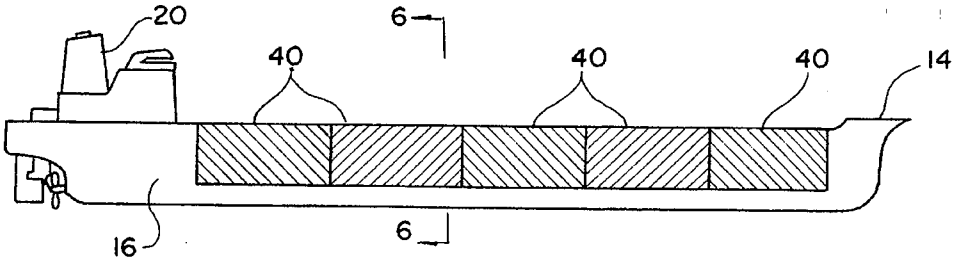
FIG. 2 is a side view of the vessel showing position of the collision guards.

Referring now the drawings in more detail, numeral 10 designates a marine vessel in accordance with the present invention. The vessel 10 comprises a hull 12 having a bow portion 14 and a stern portion 16. A conventional cargo vessel is also provided with a propulsion unit 18 and an accommodation/navigation unit 20. A cargo space 22 is formed between two opposing sides 24 and 26 of the hull structure. The cargo space 22 can be divided into a plurality of individual compartments 46 (see FIG. 3) wherein liquid or dry cargo is loaded.

Figure 4:
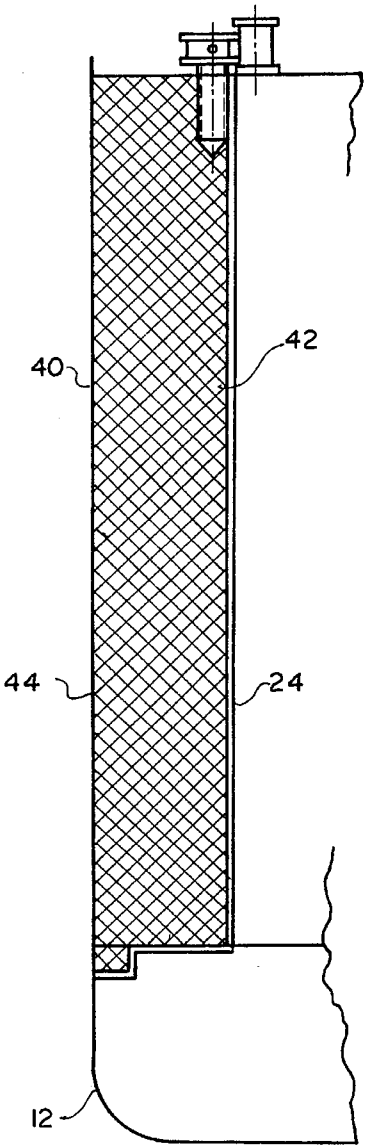
FIG. 4 is a detail view illustrating position of the improved securing device with the collision guard mounted on the hull of the vessel.
Figure 6:
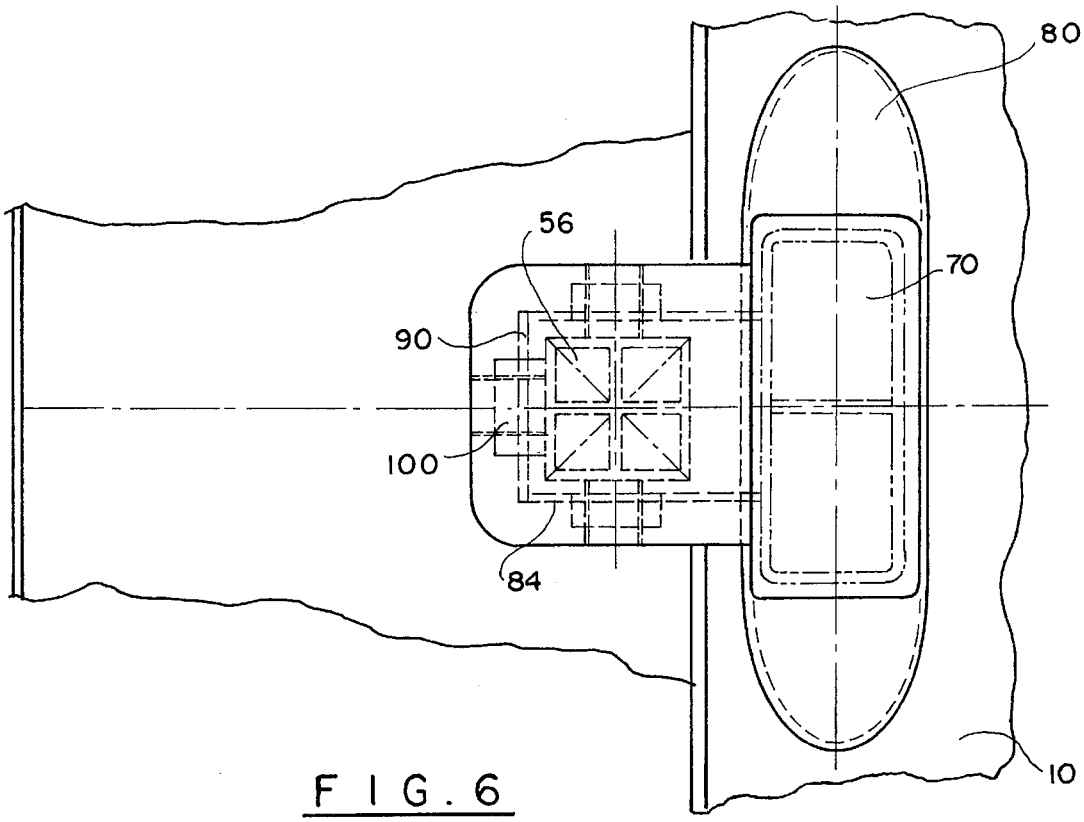
FIG. 6 is a top schematic view illustrating the relative position of the collision guard securing device and the attachment bolster.
Figure 7:
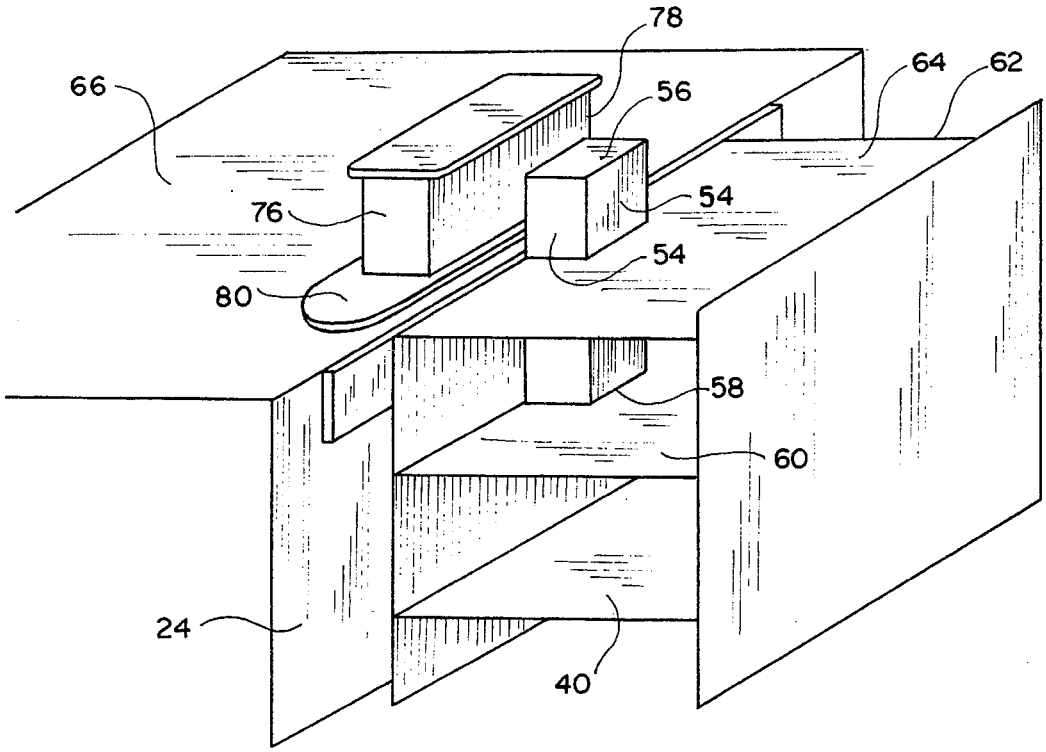
FIG. 7 is a perspective view illustrating a portion of the securing device before fitting the post with the retainer cap.

Collision guards 30 and 32 are mounted on the port 24 and starboard 26, respectively. If desired, the collision guards 30 and 32 can be composed of a plurality of individually mounted and closely fitted modules 40 which are designed to have inner walls 42 conforming to the streamlined exterior wall of the vessel, while the exterior walls 44 are made contiguous with the exterior lower side of the hull 12, as can be better seen in FIG. 4.

The securing device in accordance with the present invention is designated by numeral 50 in the drawings. The securing device comprises a vertically extending post 52 defined by vertically extending side plates 54 and a top plate 56. The bottom 58 of the post 52 rests on one of the horizontally extending dividing walls 60 of the collision guard 62. The top of the post 52 extends above a top surface 64 of the collision guard 62 and above a top deck 66 of the vessel 10.

Fixedly attached to the top deck 66 of the ship 10 is a bolster, or attachment means 70 which extends upwardly from the top deck 66 a distance above the top surface 64 of the post 52. The bolster 70 comprises a pair of vertically extending side walls 72, 74 a pair of end walls 76, 78 secured on a bottom plate 80 which rests on the top deck 66.

A pair of elongated plates 84 and 86 extend perpendicularly from the side wall 72 in a spaced-apart vertical relationship to each other. A box like enclosure 90 is mounted in a space between the bottom surface of the upper retainer plate 84 and a top surface of the lower retainer plate 86. The enclosure 90 is defined by three side walls 91 and a portion of the side wall 72 of the bolster 70.

The bottom surface 92 of the upper retainer plate 84 contacts the top surface 56 of the post 52, while a cutout 94 formed in the lower retainer plate 86 allows the post 52 to extend through the plate 86 and further through the cutout 96 formed in the upper dividing wall 64 of the collision guard 40.

Figure 9:
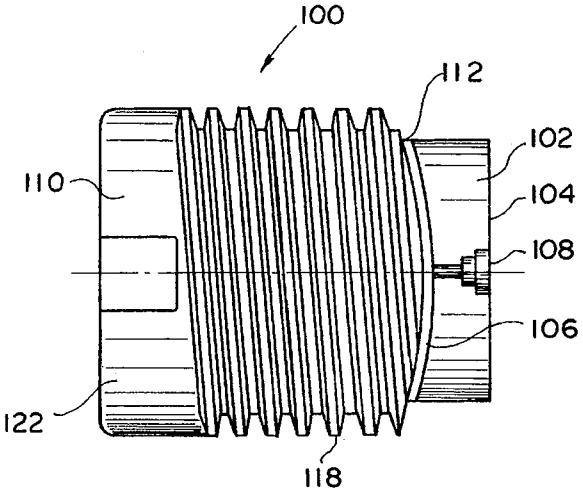
FIG. 9 is a detailed view illustrating a screw jack used in the device of the present invention for securing the retainer cap to the post.
Figure 8:
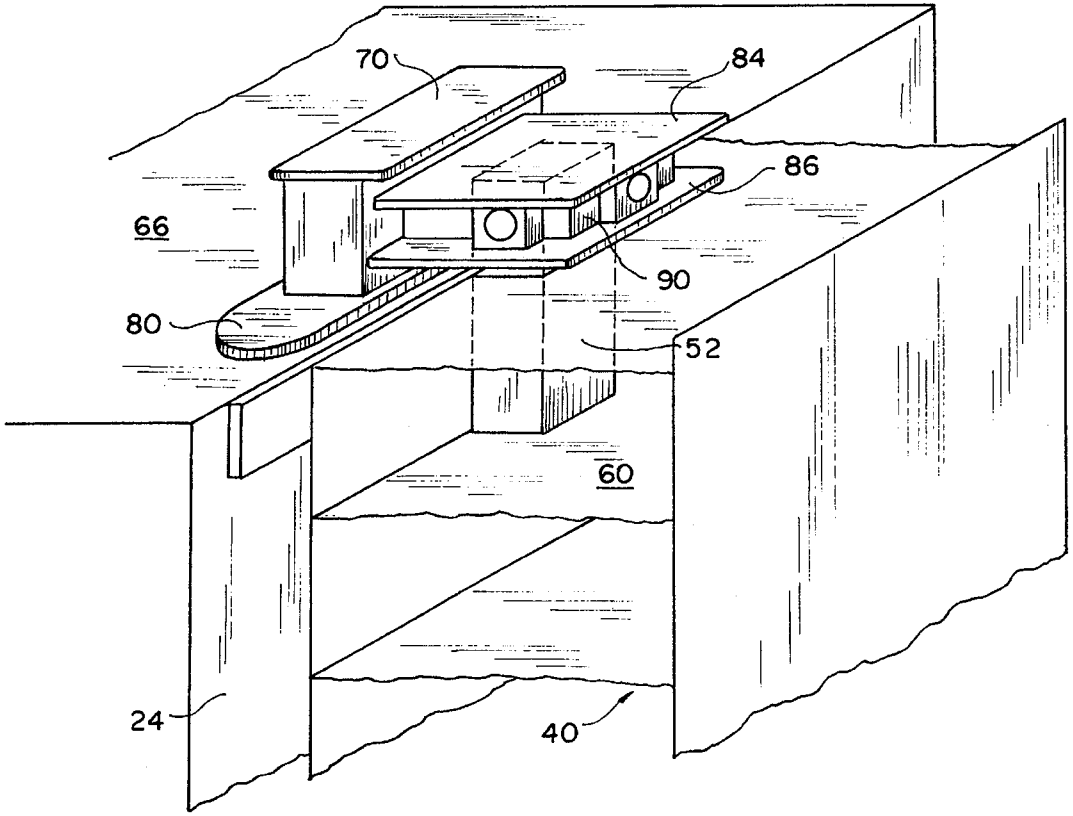
FIG. 8 is a perspective view illustrating position of the retainer plates with the post.

To compensate for possible misalignment of the plates 84 and 86 during welding, adjustment screws 100 are provided on three side walls 91 of the enclosure 90. As can be seen in FIG. 9, each adjustment screw 100 comprises a pressure plate 102 which has a contacting wall 104 defined by a circular plate, and inwardly concave seat 106 which is defined by a spherical recess in the opposite side of the pressure plate 102. A counter-sunk bolt 108 extends through the center of the plate 102 outwardly through the seat 106.

A screw jack 110 is provided with a matching seat-contacting surface 112 which is formed convex outwardly to match the seat 106 of the pressure plate 102. A shaft of the jack 110 is provided with screw-type threads 114 which are adapted for engagement with corresponding inner threads 120 formed in the opening of the enclosure wall 90. An aperture in the surface 112 is matchingly threaded to receive a shank of the counter-sunk screw 108, so as to ensure a fixed attachment of the screw jack 110 and the pressure plate 102 after the surfaces 106 and 112 have been brought into contact.

A free end 122 of the screw jack 110 is provided with means for receiving application of torque from an exterior power source (not shown) which rotates the screw jack 110 and brings it into contact with the pressure plate 102. The arrangement of the pressure plate and the screw jack ensures full contact between the post 52 and the adjustment screw 100 despite any distortion or misalignment that may result from welding the retainer plates 84 and 86 to the bolster 70. The adjustment screws 100 can be selectively rotated to advance them within the apertures in the side walls 91 of the enclosure 90 and contact the post 52. Provision of the adjustment screws 100 ensures accurate and complete contact between the cap, or retainer and the three vertical faces of the post 52.

Figure 5:
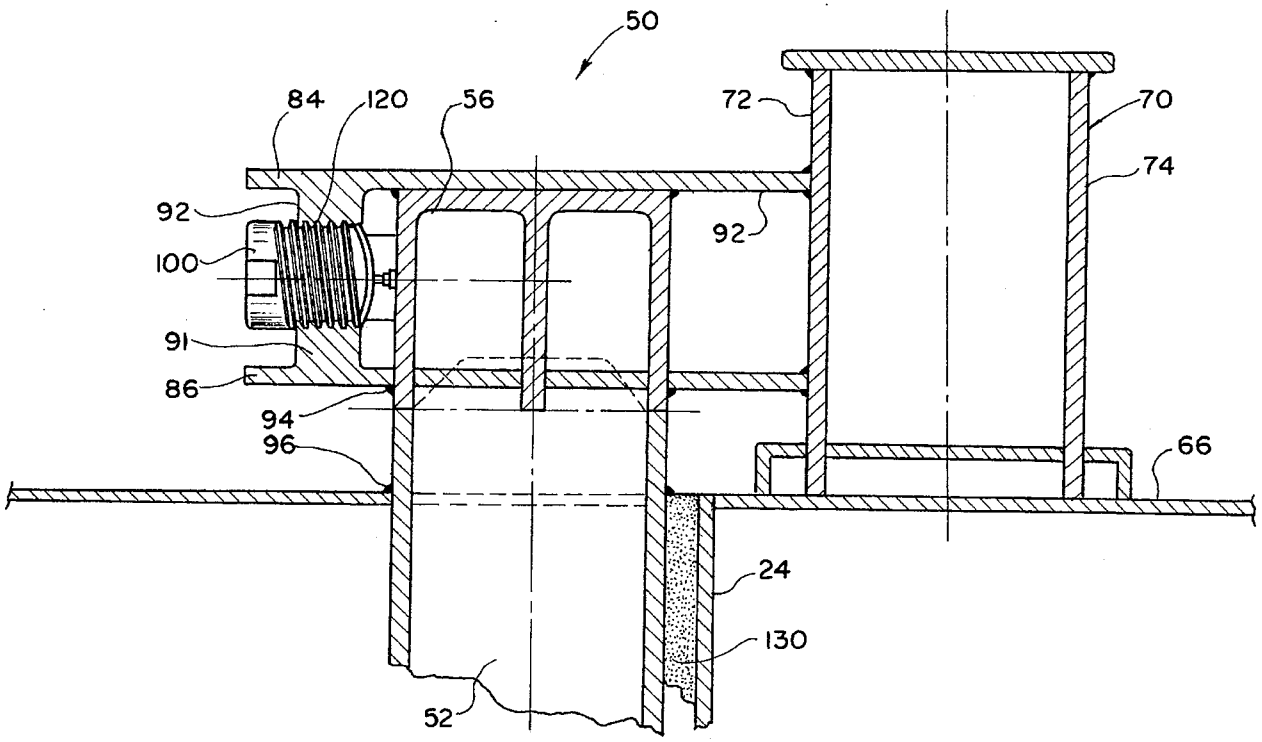
FIG. 5 is a cross sectional detail view illustrating the device of the present invention as secured to an attachment bolster mounted on a deck of a ship.

As can be seen in FIG. 5, the collision guard module 40 is mounted a distance from the side walls 24 and 26 of the hull 12. To prevent access of corrosive seawater into the gap formed between the module and the hull, a seal 130 is formed in the gap, the seal 130 being formed from a moldable material which hardens when cooled at ambient temperature.

Avoiding recesses in the top of the guard for the post-to-ship connection permits easier collision guard fabrication, avoids pockets for sea water to gather and cause rusting and eliminates the need for numerous access openings in the top of the collision guard.

All connection work is done on the open top deck 66 of the vessel 10, with ample space and easy access both to install and to continuously maintain the connections of the collision guards to the ship. This ease of accessibility for inspection and maintenance ensures greater safety during the life of the ship, leads to ease of construction and lower cost.

Many changes and modifications can be made in the design of the present invention without departing from the spirit thereof. I, therefore, pray that my rights to the present invention be limited only by the scope of the appended claims.

I claim:

1. A device for securing a collision guard to a side of a vessel, comprising:

a vertically oriented post securely attached to and extending upwardly from the collision guard;

a retainer cap means for receiving and retaining at least a portion of said post therein, said retainer cap means comprising an upper horizontally extending retainer plate and a spaced-apart lower horizontally extended retainer plate, and an enclosure secured between said upper and lower retainer plates, said enclosure being mounted in at least partially surrounding relationship about said post, said enclosure being defined by side walls extending in a substantially parallel relationship to vertically extending side walls of the post, each of said walls of the enclosure being provided with a through operture;

means carried by said retainer cap means for adjustably securing the post to said retainer cap means, wherein said means for adjustably securing the post to the retainer cap means comprises a plurality of adjustment screws, each adjustment screw being adjustably selectively threadably engagable within an operture formed in the side wall of the enclosure; and means for attaching the retainer cap means to the vessel.

2. The device of claim 1, wherein each of said adjustment screws comprises a pressure plate for contacting the post and a threaded screw jack having one surface which engages the pressure plate and a free end adapted to receive torque from an external power source.

3. A device for securing a collision guard to a side of vessel, comprising:

a vertically oriented post fixedly attached to and extending upwardly from the collision guard;

a retainer cap means for receiving at least a portion of said post therein, the retainer cap means comprising a pair of vertically spaced-apart retainer plates which extend substantially perpendicularly to a longitudinal vertical axis of the post, said retainer plates defining a gap within which a top part of the post extends, said retainer cap means comprising an enclosure mounted between said upper and said lower retainer plates in a partially surrounding relationship about said post, said enclosure being defined by side walls extending in a substantially parallel relationship to vertically extending side walls of the post, each of said enclosure walls being provided with a through operture;

means carried by said retainer cap means for allowing adjustable securing of the post to said retainer cap means, said securing means comprising a plurality of adjustment screws, each adjustment screw being adjustably selectively threadably engagable within an operture formed in the enclosure side walls; and means for attaching the retainer plates to the vessel, said attaching means comprising a bolster securly mounted on an upper deck of the vessel, and wherein said retainer plates are fixedly attached to said bolster and extend outwardly therefrom.

4. The device of claim 3, wherein each of said adjustment screws comprises a pressure plate for contacting a side wall of the post and a threaded screw having one surface which engages said pressure plate and a free end adapted to receive torque from an external power source.

5. A device for securing a collision guard to a side of a vessel, comprising:

a vertically oriented post fixedly attached to and extending upwardly from the collision guard, said post having a plurality of side walls and a top part;

a retainer cap means for receiving the top part of the post therein, said retainer cap means comprising an upper horizontally extending retainer plate and a vertically spaced-apart lower horizontally extending retainer plate, and an enclosure secured between said upper and said lower retainer plates, said enclosure being mounted in at least partially surrounding relationship about the side walls of the post, said enclosure being defined by side walls which extend in substantially parallel relationship to the side walls of the post, and wherein each of said enclosure walls being provided with a through aperture;

means carried by said retainer cap means for adjustably securing the post to said retainer cap means, said means for adjustably securing the post to the retainer cap mean comprising a plurality of adjustable screws, each adjustment screw being adjustably selectively threadably engageable within an aperture formed in a side wall of the enclosure, each of said adjustment screws comprising a pressure plate for contacting the post and a threaded screw jack having one surface which engages the pressure plate on a side opposite from said post and a free end adapted to receive rotation from an external power source for selectively adjustably contacting the side wall of the post; and means for attaching the retainer cap means to the vessel said attachment means comprising a bolster securely mounted on an upper deck of the vessel, and wherein said retainer plates are fixedly attached to said bolster and extend outwardly therefrom in a substantially perpendicular relationship to a longitudinal vertical axis of the bolster.

* * * * *